US005956548A

United States Patent [19]

Hattori

[11] Patent Number: 5,956,548

[45] Date of Patent: Sep. 21, 1999

[54] IMAGE FORMING APPARATUS

[75] Inventor: Tomoaki Hattori, Nagoya, Japan

[73] Assignee: Brother Kogyo Kabushiki Kaisha, Nagoya, Japan

[21] Appl. No.: 09/162,154

[22] Filed: Sep. 29, 1998

[30] Foreign Application Priority Data

| | | | |
|---|---|---|---|
| Sep. 30, 1997 | [JP] | Japan | 9-265853 |
| Sep. 30, 1997 | [JP] | Japan | 9-265854 |
| Sep. 30, 1997 | [JP] | Japan | 9-265855 |
| Sep. 30, 1997 | [JP] | Japan | 9-265856 |

[51] Int. Cl.[6] ..... G03G 15/02

[52] U.S. Cl. ..... 399/168; 399/169; 399/170; 399/171; 399/174

[58] Field of Search ..... 399/168, 169, 399/170, 171, 174, 175, 176

[56] References Cited

U.S. PATENT DOCUMENTS

| | | | |
|---|---|---|---|
| 5,606,398 | 2/1997 | Ender | 399/168 |
| 5,655,187 | 8/1997 | Watanabe et al. | 399/172 |
| 5,729,800 | 3/1998 | Ohba et al. | 399/159 |
| 5,741,504 | 4/1998 | Akinaga et al. | 399/171 |

FOREIGN PATENT DOCUMENTS

| | | |
|---|---|---|
| A-2-189565 | 7/1990 | Japan . |
| A-5-88587 | 4/1993 | Japan . |
| A-5-216328 | 8/1993 | Japan . |

*Primary Examiner*—Richard Moses
*Assistant Examiner*—Shival Virmani
*Attorney, Agent, or Firm*—Oliff & Berridge, PLC

[57] ABSTRACT

An image forming apparatus includes: a photosensitive unit having a surface portion of negatively charging property and moved in a predetermined direction; a first charging device disposed opposite to the photosensitive unit with a first spacing therebetween and for charging the surface of the photosensitive unit to a first charged potential of negative polarity by a negative voltage; a second charging device disposed opposite to the photosensitive unit with a second spacing therebetween at a position downstream of the first charging device in a movement direction of the photosensitive unit and for charging the surface of the photosensitive unit charged by the first charging device to a second charged potential of negative polarity by a positive voltage, the second charged potential having an absolute value smaller than an absolute value of the first charged potential; an electrostatic latent image forming device for forming an electrostatic latent image on the photosensitive unit; and a developer carrying device for carrying and conveying developer and for developing the electrostatic latent image formed by the electrostatic latent image forming device by using the developer to form a visible image. The charging efficiency of the first charging device is set to be larger than 10%.

20 Claims, 9 Drawing Sheets

IMAGE FORMING APPARATUS

BACKGROUND OF THE INVENTION

1. Field of the Invention

The present invention relates to an electrophotography type image forming apparatus such as a laser beam printer, a facsimile and a copy machine. More specifically, the present invention relates to an image forming apparatus which charges a surface of a photosensitive drum to a predetermined electric potential by a charger and forms an electrostatic latent image by an exposure, thereby to performing development.

2. Description of the Prior Art

Recently, as an developing method of an electrophotography type image forming apparatus, a so-called impression developing method is broadly used, which utilizes a conductive elastic roller as a developing roller carrying toner and performs development by pressing the developing roller onto a photosensitive drum to perform development.

Specifically, in this developing method, the surface of the photosensitive drum is uniformly electrically charged by a corona electrical charger and then is exposed by an exposing unit to form an electrostatic latent image. Then, the toner is applied to the photosensitive drum surface by the developing roller, and the toner is transferred to the electrostatic latent image side by generating a given developing electric field between the developing roller and the photosensitive drums, thereby carrying out the development.

While this developing method can utilize both positively charged toner and negatively charged toner, the negatively charged toner are primarily used in view of the stability of the electric charge characteristic.

For example, a printer performing the image exposure by a laser beam and the like utilizes a reversal developing method in which the negatively charged toner is used. Additionally, in such a printer, the charging polarity of the photosensitive drum is set to the negative polarity to correspond to the negatively charged toner, and the discharge voltage polarity of the corona electric charging device is also set to the negative polarity. With this arrangement, good print quality is achieved by using the negatively charged toner of stable charge characteristic.

However, there is such a problem that the corona electric charger ionizes oxygen molecules to produce ozone ($O_3$). There are known that the quantity of ozone produced is substantially proportional to a current flown through the discharge electrodes and that the negative polarity discharge produces more ozone than the positive polarity discharge.

In order to overcome this problem, there is proposed a printer, disclosed in the Japanese Patent Application Laid-Open under No. 5-88587, which uses a distributed organic photosensitive unit of positive charging characteristic and positively charging toner. This printer can use the charger for performing positive polarity discharge as the corona electric charger, and hence this results less ozone production.

However, in the case of using the organic photosensitive unit of positively charging property, the material available for use as the organic photosensitive unit is restricted, compared with the case of using the organic photosensitive unit of negatively charging property, because there are less materials having positively charging property.

Further, in the case of performing reversal development using the positively charging organic photosensitive unit, the positively charging toner should be used. However, the positively charging toner, particularly toner primarily made of polyester, is less reliable in the stability of charging polarity characteristic than negatively charging toner because polyester itself has negatively charging property.

On the other hand, Japanese Patent Application Laid-Open under No. 5-216328 discloses a proposal in which the ozone production is suppressed by reducing the current flown through the discharge electrode of the corona discharging unit using the negatively charging organic photosensitive unit and negatively charging toner.

However, it is known that the negative polarity discharge by the corona electrically charger produces ozone of more than ten times denser than the positive polarity discharge. The electrical charger disclosed in Japanese Patent Application Laid-Open under No. 5-216328 is a Scorotron type charger having grid electrodes. In order to charge the photosensitive unit to a degree necessary to form an electrostatic latent image by the Scorotron type charger, substantial quantity of current, including current flown through the grid electrodes, should be flown through the discharge electrode due to its structure, and hence the charge efficiency becomes low. In this view, there is a limitation in reducing the discharge current in the Scorotron type charger, and the negative polarity discharge of substantial current quantity should be carried out in the end. Therefore, it is still difficult to sufficiently suppress the ozone production.

SUMMARY OF THE INVENTION

It is an object of the present invention to provide an image forming apparatus capable of sufficiently suppress the ozone production even if the photosensitive unit is negatively charged.

According to one aspect of the present invention, there is provide an image forming apparatus including: a photosensitive unit having a surface of negatively charging property and moved in a predetermined direction; a first charging device disposed opposite to the photosensitive unit with a first spacing therebetween and for charging the surface of the photosensitive unit to a first charged potential of negative polarity by a negative voltage; a second charging device disposed opposite to the photosensitive unit with a second spacing therebetween at a position downstream of the first charging device in a movement direction of the photosensitive unit and for charging the surface of the photosensitive unit charged by the first charging device to a second charged potential of negative polarity by a positive voltage, the second charged potential having an absolute value smaller than an absolute value of the first charged potential; an electrostatic latent image forming device for forming an electrostatic latent image on the photosensitive unit; and a developer carrying device for carrying and conveying developer and for developing the electrostatic latent image formed by the electrostatic latent image forming device by using the developer to form a visible image, wherein a charging efficiency of the first charging device is set to be larger than 10%.

In accordance with the image forming apparatus thus configured, when the photosensitive unit is moved in a predetermined direction to a position opposite to the first charging device, its surface is charged by the negative voltage of the first charging device to the first charged potential at this opposite position. Further, at the position opposite to the second charging device, the surface of the photosensitive unit is charged to the second charged potential by the positive voltage of the second charging device. Therefore, the absolute value of the potential of the surface is reduced, with its polarity being unchanged, and hence the surface is charged to a desired potential for the developing process, which is still of negative polarity but has reduced absolute value. On the photosensitive unit thus charged, the electrostatic latent image is formed, and then the image is developed as a visible image by using the developer carried by the developer carrying device.

In this way, while the first charging device charges the surface of the photosensitive unit to the negative potential, the second charging device charges the surface by the positive voltage to the second charged potential to reduce the absolute value of the negative potential of the surface, thereby reducing the ozone 10 production. In addition, since the first charging device has the charging efficiency larger than 10%, a necessary charging can be carried out by less discharge current, thereby reducing the ozone production.

In a preferred embodiment, the first charging device may include: a first discharge wire disposed opposite to the photosensitive unit with the first spacing; and a first power supply for allowing the first discharge wire to produce a negative voltage, the first charging device charging the surface of the photosensitive unit to the first charged potential with the charging efficiency larger than 10%, and the second charging device may include: a second discharge wire disposed opposite to the photosensitive unit with the second spacing; a second power supply for allowing the second discharge wire to produce a positive voltage; and a control electrode disposed between the second discharge wire and the photosensitive unit and having a negative potential which absolute value is smaller than the absolute value of the first charged voltage, the second charging device charging the surface of the photosensitive unit charged to the first charged potential by the first charging device to the second charged potential which is substantially equal to the potential of the control electrode. With this arrangement, the first charging device performs charging with the charging efficiency of larger than 10% and the second charging device performs positive polarity discharge, and hence the ozone production can be suppressed.

The first charging device may be a Corotron charger and the second charging device may be a Scorotron charger having a grid electrode. In that case, since the first charging device is a Corotron charger, no discharge current flows through a grid electrode, unlike the case of Scorotron charger. The discharge current can readily be flown through the photosensitive unit, increasing the charging efficiency to be larger than 10%. Therefore, the photosensitive unit may be charged using less discharge current, and the ozone production is suppressed. Further, since the second charging device is a Scorotron charger, a stable charging is performed with a suitable voltage control by the control electrode, thereby performing excellent image formation. In addition, even if the discharge current increases, the ozone production may be suppressed because the discharge is of the positive polarity.

Preferably, the first charged potential may be smaller than a potential at which a dielectric breakdown of the photosensitive unit takes place and the second charged potential may be smaller than a potential at which a dark attenuation of the photosensitive unit takes place. By this, it is possible to avoid image formation failure due to the dielectric breakdown of the photosensitive unit. In addition, by avoiding the dark attenuation, the potential of the photosensitive unit after the charging process may be stabilized.

The developer may contain non-magnetic one-component toner of negatively charging property, and the developer carrying device may make a contact with the photosensitive unit to form a nip portion between the developer carrying device and the photosensitive unit and develop the electrostatic latent image at the nip portion. By this, the reliable developing process is performed by using the toner having stable negatively charging property.

In another preferred embodiment, the first charging device may include a constant current driving circuit. Alternatively, the first charging device may include: a first discharge wire disposed opposite to the photosensitive unit with the first spacing; and a constant current driving circuit for supplying a constant current to the first discharge wire to allow the first discharge wire to produce a negative voltage, the first charging device charging the surface of the photosensitive unit to the first charged potential with the charging efficiency larger than 10%, and the second charging device may include: a second discharge wire disposed opposite to the photosensitive unit with the second spacing; a power supply for allowing the second discharge wire to produce a positive voltage; and a control electrode disposed between the second discharge wire and the photosensitive unit and having a negative potential which absolute value is smaller than the absolute value of the first charged potential, the second charging device charging the surface of the photosensitive unit charged to the first charged potential by the first charging device to the second charged potential which is substantially equal to the potential of the control electrode.

With this arrangement, since the first charging device is driven by the constant current driving circuit, the photosensitive unit is charged by small and stable current, thereby suppressing the ozone production. Further, the first charging device may be a Corotron charger, the second charging device may be a Scorotron charger having a grid electrode, and the constant current driving circuit may control the current supplied to the discharge wire of the Scorotron charger to be constant.

In still another embodiment, the first charging device may include a constant current driving circuit having current limiting function. Alternatively, the first charging device may include: a first discharge wire disposed opposite to the photosensitive unit with the first spacing; and a constant current driving circuit having current limiting function for supplying a voltage to the first discharge wire to allow the first discharge wire to produce a negative voltage, the first charging device charging the surface of the photosensitive unit to the first charged potential with the charging efficiency larger than 10%, and the second charging device may include: a second discharge wire disposed opposite to the photosensitive unit with the second spacing, a power supply for allowing the second discharge wire to produce a positive voltage; and a control electrode disposed between the second discharge wire and the photosensitive unit and having a negative potential which absolute value is smaller than the absolute value of the first charged potential, the second charging device charging the surface of the photosensitive unit charged to the first charged potential by the first charging device to the second charged potential which is substantially equal to the potential of the control electrode.

With this arrangement, the voltage applied to the first charging device is controlled by the constant current driving circuit with current limiting function. Therefore, even if the thickness of the photosensitive layer of the photosensitive unit is reduced due to long term use and the electrostatic capacity is decreased, a stable surface charging voltage can be obtained. In addition, even if a pinhole exists on the photosensitive unit, a large current does not flow through the photosensitive unit and the dielectric breakdown of the photosensitive unit may be avoided.

Further, the first charging device may be a Corotron charger, the second charging device may be a Scorotron charger having a grid electrode, and the constant current driving circuit may control the voltage applied to the discharge wire of the Scorotron charger to be constant and control the current supplied to the discharge wire not to exceed a predetermined value.

In still another preferred embodiment, the spacing between the first charging device and the photosensitive unit may be larger than 1 mm and smaller than 30 mm. Alternatively, the first charging device may include: a first discharge wire disposed opposite to the photosensitive unit with a spacing larger than 1 mm and smaller than 30 mm; and a first power supply for allowing the first discharge wire to produce a negative voltage, the first charging device charging the surface of the photosensitive unit to the first charged potential with the charging efficiency larger than 10%, and the second charging device may include: a second discharge wire disposed opposite to the photosensitive unit with the second spacing; a second power supply for allowing the second discharge wire to produce a positive voltage; and a control electrode disposed between the second discharge wire and the photosensitive unit and having a negative potential which absolute value is smaller than the absolute value of the first charged potential, the second charging device charging the surface of the photosensitive unit charged to the first charged potential by the first charging device to the second charged potential which is substantially equal to the potential of the control electrode.

With this arrangement, since the spacing between the discharge electrode of the first charging device and the photosensitive unit is larger than 1 mm, no local charge is performed onto the photosensitive unit, thereby avoiding a local damage of the photosensitive unit. In addition, since the spacing is smaller than 30 mm, the discharge for the photosensitive unit does not stop and it does not require excessively large voltage application. Therefore, the photosensitive unit is charged by an appropriate applied voltage.

The spacing between the first charging device and the control electrode may be larger than 1 mm and smaller than 30 mm. With this arrangement, since the spacing between the first charging device and the control electrode is larger than 1 mm, no local charge is performed onto the photosensitive unit, thereby avoiding unevenness of charging. In addition, since the spacing is smaller than 30 mm, the discharge for the photosensitive unit does not stop and the charging does not require excessively large voltage application. Therefore, the photosensitive unit is charged by an appropriate applied voltage.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

Figure 1:
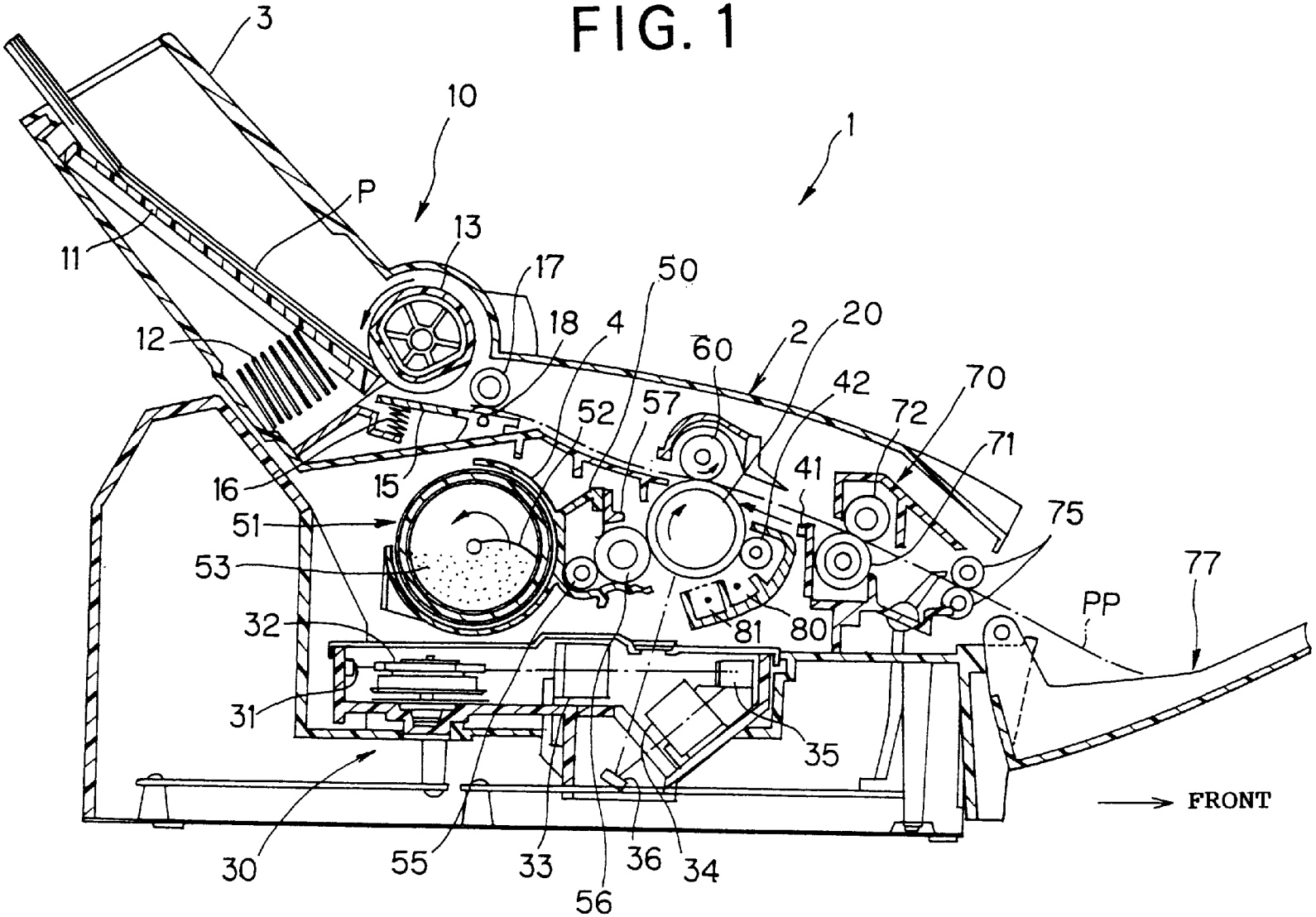
FIG. 1 is a vertical sectional view of a laser beam printer according to an embodiment of the present invention.

FIG. 1 shows a laser beam printer 1 according to an embodiment of the present invention. The laser beam printer 1 includes a main body casing 2, a feeder unit 10 for feeding papers P serving as an example of a recording medium to be formed with image, a photosensitive drum 20 which is an example of the photosensitive unit to perform the exposure process, the developing process, the transfer process, the recovery process and so on for the image formation, a fixing unit 70 for fixing the image transferred from the photosensitive drum 20 to the paper P onto the paper P, and a paper output tray 77 for receiving and accumulating the papers P, with the image formed, delivered along a conveying path PP.

The laser beam printer 1 further includes a main motor (not shown) for rotating the photosensitive drum 20 and various rollers described later, and a driving unit constructed by a combination of gears. The laser beam printer 1 further includes, along the periphery of the photosensitive drum 20, a laser scanner unit 30, a developing unit 50, a transfer roller 60, a cleaning roller 42, a charge elimination lamp 41, a Corotron charger 80 and a Scorotron charger 81. The laser scanner unit 30 serves as an electrostatic latent image forming unit for forming an electrostatic latent image on the photosensitive drum 20 which is rotated by the driving unit. The developing unit 50 has a developing roller 56 serving as a developer carrying unit for developing the electrostatic latent image formed on the photosensitive drum 20 by the toner which is an example of developer. The transfer roller 60 transfers the toner image developed on the photosensitive drum 20 to the paper P. The cleaning roller 42 temporarily sucks the remaining toner, remaining on the photosensitive drum 20 after the transfer process by the transfer roller 20, in order to return the remaining toner to the developing unit 50 by the photosensitive drum 20 according to the cleaner-less technique at a given timing. The charge elimination lamp 41 eliminates remaining potential on the photosensitive drum 20 after the transfer process. The Corotron charger 80 is an example of a first charging unit which electrically charges the photosensitive drum 20 after the potential elimination to enable the electrostatic latent image formation, and the Scorotron charger 81 is an example of s second charging unit.

Next, the respective components of the laser beam printer 1 will be described in more detailed with reference to FIGS. 1 and 2. In FIG. 1, the feeder unit 10 has a paper pressing plate 11 which has a width substantially the same as the paper P and is disposed within the feeder unit casing 3 positioned upwardly and backwardly of the body casing 2. The paper pressing plate 11 is supported at its rear end in a swingable manner. The paper pressing plate 11 is provided with a compression spring 12 at its front end, and the spring 12 elastically urges the paper pressing plate 11 in the upward direction. In the feeder unit casing 3, the paper feeding roller 13 is rotatably provided so as to be rotated by a driving mechanism not shown at a feeding timing. The paper P is fed, one by one, from the uppermost one by the rotation of the paper feeding roller 13. The feeder unit 10 further includes a separating member 15 below the paper feeding roller 13 to prevent multiple papers P from being fed at the same time. The separating member 15 is elastically urged against the paper feeding roller 13 by the compression spring 16. At the downstream of the paper feeding roller 13 in the paper conveying direction (rightward direction in FIG. 1), a pair of resist rollers 17 and 18 are provided in a rotatable manner, respectively, for aligning the front edges of the papers P thus fed.

Figure 2:
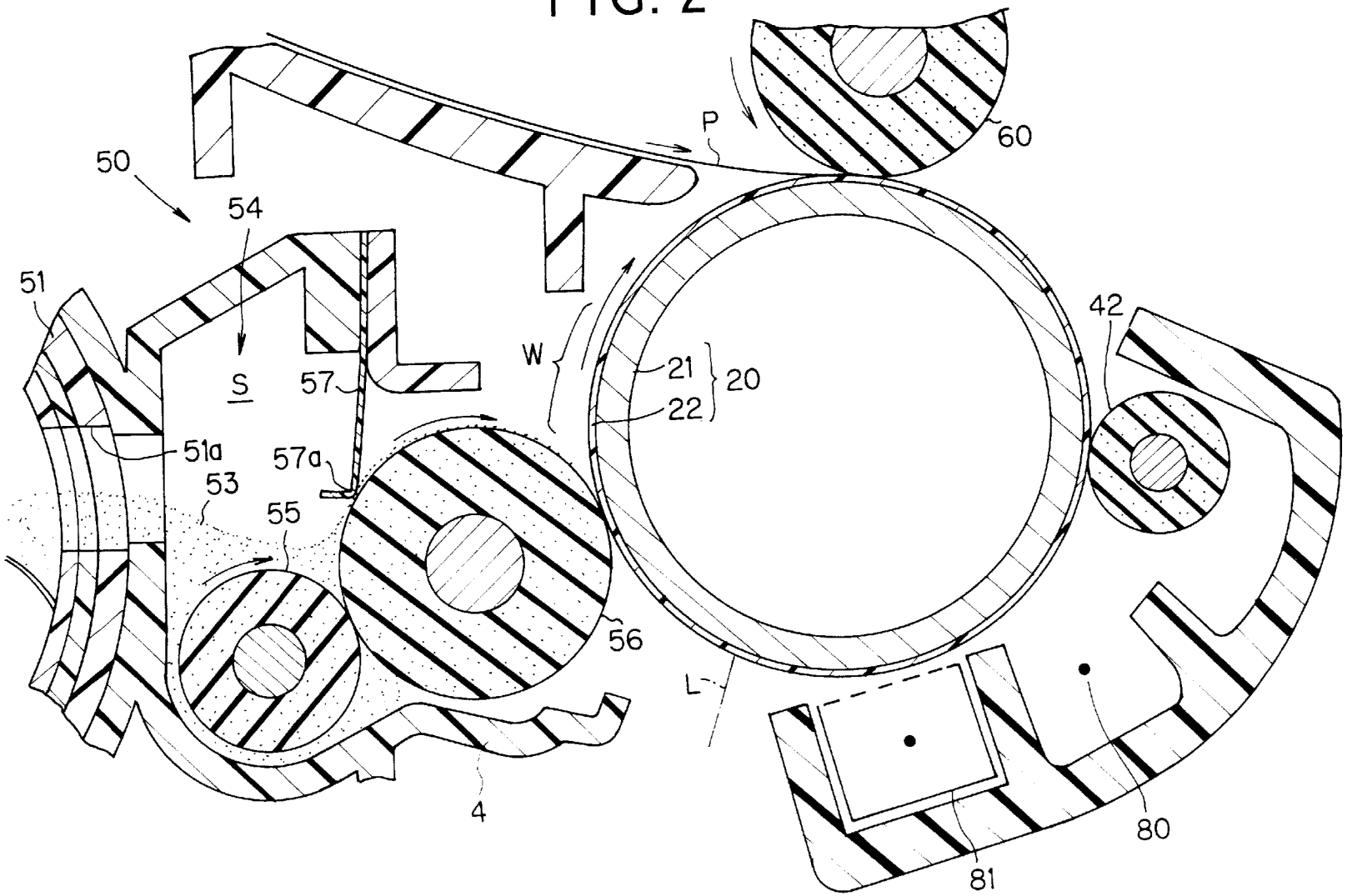
FIG. 2 is an enlarged sectional view of a developing unit and a photosensitive drum portion of the laser beam printer shown in FIG. 1.

In FIGS. 1 and 2, the photosensitive drum 20 is made of materials having negatively charging property. For example, the photosensitive drum 20 may be a photosensitive unit in which Charge Carrier Transport material (CTM) and Charge Carrier Generation Material (CGM) are laminated as Charge Carrier Generation Layer (CGL) and Charger Carrier Transport layer (CTL).

More specifically, as shown in FIG. 2, the photosensitive drum 20 has a cylindrical sleeve 21 made of aluminum serving as a main body, and a hollow drum forming a photo-conductive layer 22 made of charge carrier generation layer and charge carrier transport layer of given thickness (e.g., 22 $\mu$m) around the outer surface of the main body. The photosensitive drum 20 is provided in the main body 2 in a rotatable manner, with the cylindrical sleeve 21 being grounded. Namely, the photosensitive drum 20 is configured to develop the negatively charged toner 53 by the reversal developing method using the electrostatic latent image of negative polarity (negatively charged) formed on the photosensitive drum 20. The photosensitive drum 20 is rotated in the clockwise direction in the side view of FIGS. 1 and 2 by the driving unit.

In FIG. 1, the laser scanner unit 30 is provided under the photosensitive drum 20, and includes a laser generator 31 for generating a laser light L for forming the electrostatic latent image on the photosensitive drum 20, a polygon (pentahedron) mirror 32 rotatably driven, a pair of lens 33 and 34, and a pair of reflective mirror 35 and 36. By arranging the laser scanner unit 30 under the photosensitive drum 20, the total length of the unit in the conveying direction may be shortened. In addition, the laser printer 1 itself may be compact, and the electrostatic latent image may be formed on the photosensitive drum 20 by the laser light L emitted from the laser scanner unit 30 without an interference with the paper transportation.

The Corotron charger 80 has a charging wire made of tungsten, for example, and performs negative polarity corona discharge. In this embodiment, no shield electrode is provided around the charging wire.

The Scorotron charger 81 has a charging wire made of tungsten, for example, a shield electrode and a grid electrode, and performs corona discharge by the charging wire. The Scorotron charger 81 has a positive charging polarity, and the grid electrode is set to the charged potential of the photosensitive drum 20. The details of those chargers 80 and 81 will be described later.

While this embodiment utilizes the cleaner-less method, the remaining toner on the photosensitive drum 20 never adheres to the Corotron charger 80 and the Scorotron charger 81 because they are disposed opposite to the photosensitive drum 20 in a non-contacting manner.

The charge elimination lamp 41 has a light source such as a LED (Laser Emitting Diode), an EL (Electro-Luminescence), a fluorescent light or the like. The charge elimination lamp 41 functions to eliminate the remaining charges on the photosensitive drums 20 after the transfer process, thereby to prevent the remaining charges from affecting the next electrostatic latent image and appearing on the visible image finally formed on the paper P.

The cleaning roller 42 varies the bias voltage to temporarily absorb the toner 53 remaining on the photosensitive drum 20 after the transfer process by the transferring roller 60, and then ejects the toner 53 thus absorbed to the photosensitive drum 20 at an appropriate timing that does not disturb the subsequent exposure, development and transfer processes performed on the photosensitive drum 20, thereby returning the remaining toner 53 from the photosensitive drum 20 to the developing unit 50. The cleaning roller 42 is made of, for example, conductive elastic foam such as silicon rubber or urethane rubber to which the bias voltage can be applied. While the cleaning roller 42 is provided to effectively accelerate the recovery by the cleaner-less method, a cleaning brush may be provided additionally or alternatively to the cleaning roller 42 to flatten the remaining toner 53 on the surface of the photosensitive drum 20.

In FIGS. 1 and 2, the developing unit 50 has a toner box 51 of double cylindrical structure which is attached to the developing unit casing 4 in a releasable manner. The toner box 51 receives an agitator 52 rotationally driven, and the negatively charging toner 53 having electrically insulating property. A toner storeroom 54 is created in front of the toner box 51 to store the toner 53 supplied via the toner supply opening 51*a* by means of the rotation of the agitator 52. In the toner storeroom 54, a supply roller 55 is provided in a manner rotatable and horizontally level in its longitudinal direction. Further, a developing roller 56 is provided in a manner rotatable and horizontally level in its longitudinal direction so as to form the front end portion of the toner storeroom 54 and to contact with the supply roller 55 and the photosensitive drum 20, respectively.

The supply roller 55 is made of conductive elastic foam such as silicon rubber or urethane rubber, and its resistance value at the contact with the developing roller 56 is set in a range from $5\times10^4$ to $1\times10^7$ Ω. The developing roller 56 is a conductive roller made of silicon rubber or urethane rubber, for example. The developing roller 56 has a resistance value in a range from $5\times10^4$ to $1\times10^7$ Ω between its central electrode, to which the developing bias voltage is applied, and the outer circumferential contact portion. The supply roller 55 and the developing roller 56 are configured to rotate in the clockwise direction by the driving unit, respectively.

As shown in FIG. 2, the casing 4 of the developing unit 50 has the toner storeroom 54 which is formed in a fashion to create a large space S upwardly of the supply roller 55. By this, the overfilling of the toner 53 may be avoided even if excessive quantity of toner 53 is supplied to the toner storeroom 54 via the toner supply opening 51*a*. Thus, the toner 53 is constantly kept in a powered condition, the flow property of the toner 53 is maintained, and the toner supply by the supply roller 55 may be stabilized.

In FIGS. 1 and 2, the developing unit casing 4 is; provided with a layer thickness regulating blade 57 of thin elastic plate made of stainless or phosphor bronze oriented downwardly. The bent portion 57*a* formed at the lower end of the blade 57 is in contact with the developing roller 56 in a pressed manner so that the blade 57 regulates the layer thickness of the toner 53 supplied from the supply roller 55 and adhered onto the surface of the developing roller 56 to be within a given range (approximately 7–30 $\mu$m).

The transfer roller 60 is provided to be in contact with the upper surface of the photosensitive drum 20 in a rotatable manner and is made of conductive elastic foam such as silicon rubber or urethane rubber. The transfer roller 60 has a resistance value of approximately from $1\times10^{6}$ to $1\times10^{10}$ $\Omega$ at the contact portion with the photosensitive drum 20. Namely, since the transfer roller 60 is in contact with the surface of the photosensitive drum 20, the transfer roller 60 is configured to avoid destroying the photo-conductive layer 22 formed on the photosensitive drum 20 by the voltage applied to the transfer roller 60 and additionally to ensure the reliable transfer of the toner image formed on the photosensitive drum 20 to the paper P.

The fixing unit 70 is provided downstream of the photosensitive drum 20 in the conveying direction and includes a heating roller 71 incorporating halogen lamp and a pressing roller 72. The fixing unit 70 heats and presses the toner image transferred to the lower surface of the paper P to fix the image on the paper P. A pair of conveying rollers 75 and the paper output tray 77 are provided downstream of the fixing unit 70 in the conveying direction PP.

According to this embodiment, as shown in FIG. 1, the feeding roller 13, the photosensitive drum 20, the fixing unit 70 and the conveying roller 75 are positioned substantially linearly to together define the conveying path PP, shown by the dotted line in FIG. 1, along which the paper P is conveyed from the feeding cassette 14 to the paper output tray 77.

In FIG.1, the toner 53 according to this embodiment is crushed toner made from polyester, styrene-acrylic or the like, or non-magnetic one-component toner of polymerization toner of styrene-acrylic of sphere-shape or the like, and has a particle diameter of 6–12 $\mu$m.

The toner 53 contains raw toner and silica serving as external additive agent (flow property addition agent). The raw toner contains resin, wax, carbon black and CCA (Charge Control Agent), and its charging characteristic is negative polarization due to the action of CCA and external additive agent. The silica, which is an example of external additive agent, is toner surface modifier which has an effect of increasing the flow property of toner 53 and charging characteristic of being charged in negative polarity. In addition to the function of increasing the flow property, external additive agent may have functions of avoiding toner blocking, improving the cleaning property, avoiding damages on the photosensitive drum, improving the image density, improving the image quality and so on. As external additive agent other than silica, colloidal silica, fine power of titanium oxide and aluminum oxide (alumina) may be used.

In the laser beam printer 1 configured as described above, the photosensitive drum 20 of negatively charging property is rotationally driven by the driving unit in the clockwise direction in the side view of figures, and the supply roller 55 and the developing roller 56 are rotationally driven in the clockwise direction. As a result, each particle of the toner 53 is negatively charged by being rubbed between the supply roller 55 and the developing roller 56 and the impressing friction of the layer thickness regulating blade 57 against the developing roller 56. Then, the negatively charged toner 53 is rubbed by the developing roller 56 and the photosensitive drum 20 at the nipping portion to be further charged, adheres to the electrostatic latent image formed on the photosensitive drum 20 by the laser light L, and then is developed by the reversal development method.

With this arrangement, it is necessary to negatively charge the surface of the photosensitive drum 20 by the charging unit. However, the negative polarity discharge may result an increase of ozone concentration undesirable in view of environmental sanitation.

Considering this, in this embodiment, the charging of the photosensitive drum 20 to the desired negative potential is carried out, not by the negative polarity discharge of a single charger, but by two chargers, one for performing the negative polarity discharge and the other for performing the positive polarity discharge. In addition, in this embodiment, the current flowing through the charger for the purpose of the negative polarity discharge is remarkably reduced to suppress the ozone production by the negative polarity discharge.

In order to reduce the discharging current, it is necessary to improve the charging efficiency, which is a ratio of the actual charging current on the photosensitive drum surface to the total discharging current. In this embodiment, no shield electrode is provided to the Corotron charger 80 performing the negative polarity discharge and the discharge is performed only by the charging wire, thereby improving the charging efficiency. Namely, since the discharge from the charging wire only affects the photosensitive drum in the absence of the shield electrode, the charging efficiency may be improved and the necessary discharge current may be remarkably reduced.

Figure 3:
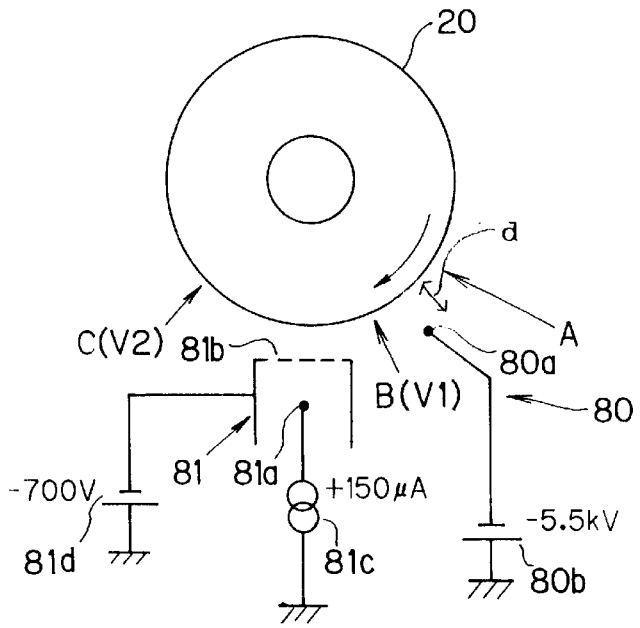
FIG. 3 is a schematic diagram showing a configuration of a charging unit of the laser beam printer shown in FIG. 1.

The charging unit of this embodiment will be described in detail with reference to FIG. 3. In this embodiment, the Corotron charger 80 with no shield electrode is provided as a first charging unit for performing the negative polarity discharge, and the Scorotron charger 81 is provided downstream of the Corotron charger 80 in the rotation direction of the photosensitive drum 20 as a second charging unit for performing the positive polarity discharge. The reason why the Corotron type charger is used as the first charging unit is to improve the charging efficiency as described above. The reason why the Scorotron type charger is used as the second charging unit is that the Scorotron type charger is excellent in the stability of the surface potential of the photosensitive drum 20. In other words, even if the discharge distribution of the discharge electrode is not quite good, the Scorotron type charger can make the surface potential of the photosensitive drum close to the grid voltage to be of uniform potential by maintaining the constant bias voltage applied to the grid electrode.

The Corotron charger 80 includes a discharge wire 80*a* serving as a first discharge wire, and a power supply 80*b* serving as a first power supply. In this embodiment, for example, the voltage of the power supply 80*b* is set to −5.5 kV and the discharge current for the discharge wire 80*a* is set to 20 μA. The target charging voltage of the photosensitive drum 20 by this Corotron charger 80 is set to −1200 V.

On the other hand, the Scorotron charger 81 includes a discharge wire 81*a* serving as a second discharge wire, a grid 81*b* serving as a control electrode, a constant current circuit 81*c* serving as a second power supply, and a power supply 81*d* for applying voltage to the grid 81*b*. The grid voltage is set to −700 V by the power supply 81*d*, and the discharge current of +300 μA is flown through the discharge wire 81*a* by the constant current circuit 81*c*. The target charged potential of the photosensitive drum 20 by the Scorotron charger 81 is set to −700 V.

The photosensitive drum 20 is designed as follows: the thickness d=22 μm, the linear velocity=58.3 mm/s, the photosensitive unit coating width=242.5 mm, the dielectric constant in vacuum $\epsilon_0$=8.854×10E−12(F/m), and the relative dielectric constant $\epsilon$=3.2.

Here, the electrostatic capacity C for unit time of the photosensitive unit (1 second) is expressed as follows:

$$C=(\epsilon_0 \times \epsilon \times S)/d,$$

$\epsilon$:relative dielectric constant of photosensitive unit,

S: charged area of the photosensitive unit per 1 second, d: film thickness, $\epsilon_0$: dielectric constant in vacuum.

Assuming that the surface potential of the photosensitive drum is V, V=Q/C. Since the above electrostatic capacity C is the value of unit time, Q=A (current) stands.

Accordingly, if the surface potential V is measured, the charge current of the photosensitive drum surface can be obtained from the equation A=CV. By comparing this with the discharge current flowing through the wire, the charging efficiency may be obtained.

By examining the charging efficiency of the Corotron charger of the above mentioned configuration, the following result is obtained. The surface potential of the photosensitive drum 20 is measured with varying the voltage applied to the Corotron charger 80 to increase the discharge current from 10 μA to 36 μA with 2 μA step. Then, the theoretical value of the surface potential V of the photosensitive drum 20 is obtained from the electrostatic capacity C and the discharge current value per unit time (Q=A), and then the obtained value is compared with the measured result. The comparison result is shown in FIG. 4.

Figure 4:
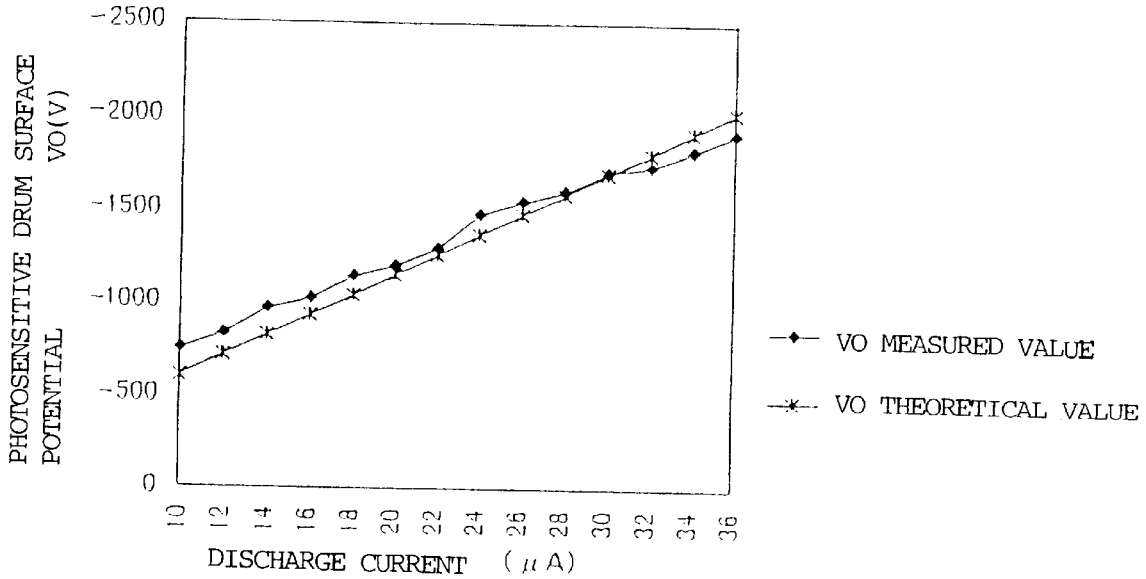
FIG. 4 is a graph showing measured values and theoretical values of surface potential of the photosensitive drum with respect to discharge current of a Corotron charger.

As seen in FIG. 4, the measured value of the surface potential V of the photosensitive drum 20 is substantially equals to its theoretical value, and it is confirmed that the charging efficiency achieved by this embodiment is approximately 100%.

Next, the charging efficiencies of this embodiment and the conventional apparatus will be compared and studied.

A The image forming apparatus having both Corotron charger and Scorotron charger is disclosed in Japanese Patent Application Laid-Open under No. 2-189565, for example. This apparatus has an object of stabilizing the photosensitive drum surface potential at the time of exposure by averaging the unevenness of the photosensitive drum surface potential by the Corotron charger by using the Scorotron charger. As appreciated from the fact that the Corotron charger is provided with shield electrode, the apparatus of this Patent Application does not intend to improve the charging efficiency to reduce ozone production.

Japanese Patent Application Laid-Open under No. 2-189565 does not disclose the discharge current by the Corotron charger, and only discloses that the applied voltage is −5.8 kV and the charged potential of the photosensitive drum by the Corotron charger is −800 V.

Now, the charging efficiency achieved by the configuration disclosed in Japanese Patent Application Laid-Open under No. 2-189565 will be presumed by referring to the paper named "Discharge Simulation of electrophotography Corona Charger" (by Yoshio Watanabe), Electrostatics papers, Volume 14, number 6, 1990.

The above paper teaches that the discharge current of approximately 125 μA is required to charge the photosensitive drum to −800 V by using Corotron charger with shield electrode. On the other hand, it is found from the result of the theoretical values shown in FIG. 4 that the photosensitive unit current is around 12 μA. Therefore, in the configuration disclosed in Japanese Patent Application Laid-Open under No. 2-189565, the charging efficiency is assumed to be less than 10%.

In this way, the configuration of Japanese Patent Application Laid-Open under No. 2-189565 requires the discharge current of approximately 125 μA to obtain the photosensitive unit current of approximately 12 μA. On the contrary, according to this embodiment, the same photosensitive current can be obtained by the discharge current of approximately 12 μA. Therefore, the apparatus of this embodiment can reduce the discharge current of Corotron charger to be about one-tenth of the conventional apparatus. In this way, the ozone concentration proportional to the discharge current may be remarkably reduced.

In order to carry out satisfactory charging, it is necessary to appropriately set the spacing between the discharge wire 80*a* of the Corotron charger 80 and the photosensitive drum 20. Namely, since the Corotron charger 80 is not provided with a grid electrode in the spacing between itself and the photosensitive drum, the discharge may change to a so-called streamer discharge due to the flexing of the discharge wire 80*a*, or the roundness or levelness of the photosensitive drum 20, if the spacing between the discharge wire 80*a* and the photosensitive drum 20 is too small. The streamer discharge is a discharge caused locally for the surface of the photosensitive drum 20, and transition to the streamer discharge causes a spot-like damage on the photosensitive drum, adversely affecting the image.

On the contrary, if the spacing between the discharge wire 80*a* and the photosensitive drum 20 is too large, the discharge for the photosensitive drum may be insufficient, or an excessive voltage is needed to be applied onto the discharge wire 80*a*, thereby disabling to establish the present invention as an actual apparatus.

In this view, an experiment is carried out, in which the spacing d between the discharge wire 80*a* and the photosensitive drum 20 is varied. As a result, the experiment taught that the streamer discharge takes place if the spacing is equal to or less than 1 mm and the discharge stops if the spacing is more than 30 mm. It is also found that the applied voltage up to 10 kV is needed if the spacing is more than 30 mm.

Figure 12:
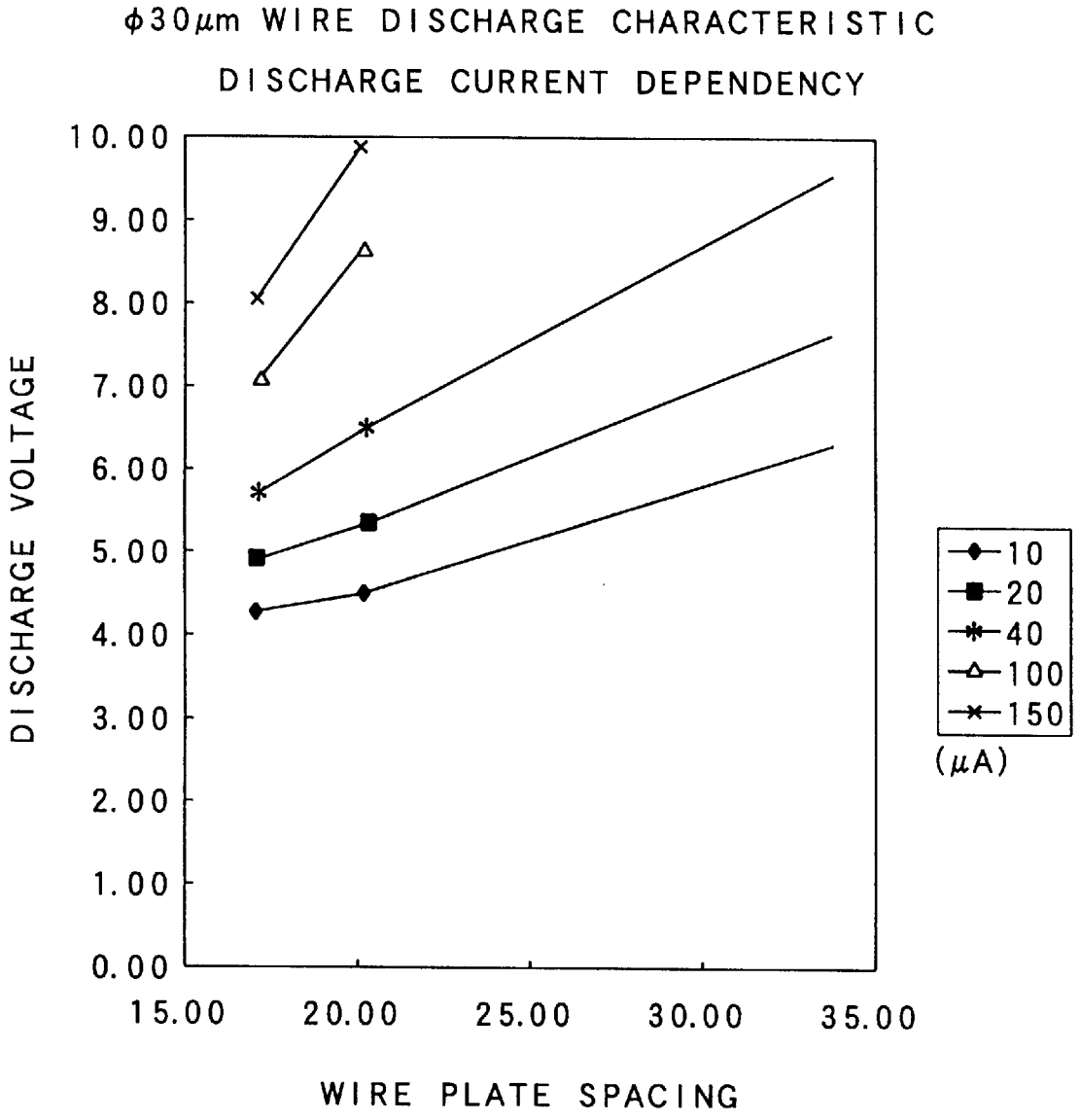
FIG. 12 is a graph showing the relation between the discharge current and the discharge voltage with respect to the spacing between the discharge wire and the grid electrode in case of using the discharge wire having a diameter of 30 $\mu$m.

Due to the problem in the withstand pressure of the high-pressure transformer, special insulation is required to achieve the voltage output larger than 10 kV, and this increases the cost. FIG. 12 shows the relationship of the discharge current, the discharge voltage and the spacing between the wire and the grid electrode when the wire has a diameter of 30 μm. From FIG. 12, it is understood that the above spacing should be no more than 40 mm to achieve the discharge voltage of no more than 10 kV using the wire of 30 μm diameter, assuming that the current necessary for the stable discharge is larger than 40 μA. Considering the bias voltage of the grid and the increase of the discharge voltage due to the stain of the wire, it is preferred that the spacing is set to be no more than 30 mm. In addition, such a relationship of the discharge spacing is also important when the grid electrode is provided between the photosensitive drum 20 and the discharge wire 80*a*.

While this embodiment is directed to the Corotron charger 80 with no grid electrode, the application of the present invention is not limited to the Corotron charger. The present invention is applicable to a Scorotron charger if the above discussed charging efficiency is ensured. In the case of Scorotron charger, the above study is applicable to the spacing between the discharge wire and the grid electrode. Namely, the transition to the streamer discharge may take place if the spacing between the discharge wire and the gird electrode is too small, and the discharge of the grid electrode may be insufficient or the necessary voltage applied to the grid electrode becomes too large if the spacing is too large.

Therefore, in both cases of using the Corotron charger like this embodiment and using the Scorotron charger, it is preferred that the spacing between the discharge wire and a primary charging object (i.e., the photosensitive drum or the grid electrode) is set in a range from 1 mm to 30 mm. By carrying out the charging with maintaining the spacing and the charging efficiency discussed above, it is possible to achieve the satisfactory image formation with reduced ozone production.

Not only the apparatus disclosed in the above mentioned Patent Application, an apparatus using Corotron charger is conventionally broadly used in apparatuses of various configurations. However, the configuration of those Corotron chargers are similar among them, and their charging efficiencies are assumed to be similar to that of the above mentioned Patent Application. Therefore, in the case of using the Corotron charger, it is understood that the charging efficiency should be more than 10% in order to reduce ozone concentration compared with those conventional apparatuses.

However, the charging efficiency may vary dependently upon the distance between the wire and the photosensitive drum, as well as the distance between the wire and the shield electrode and the shape and/or size of the shield electrode if the shield electrode is used.

Therefore, if the condition of the charging efficiency being more than 10% is maintained, the shield electrode may be provided to stabilize the discharge. However, even if the shield electrode is provided, charging unevenness of some degree is unavoidable, and it is difficult to stabilize the surface potential of the photosensitive drum 20 only by the Corotron charger. Hence, Scorotron charger is needed. For this reason, this embodiment employs not only the Corotron charger but also the Scorotron charger.

Next, the relationship between the discharge current supplied to the Scorotron charger 81 and the ozone concentration will be studied.

Figure 5:
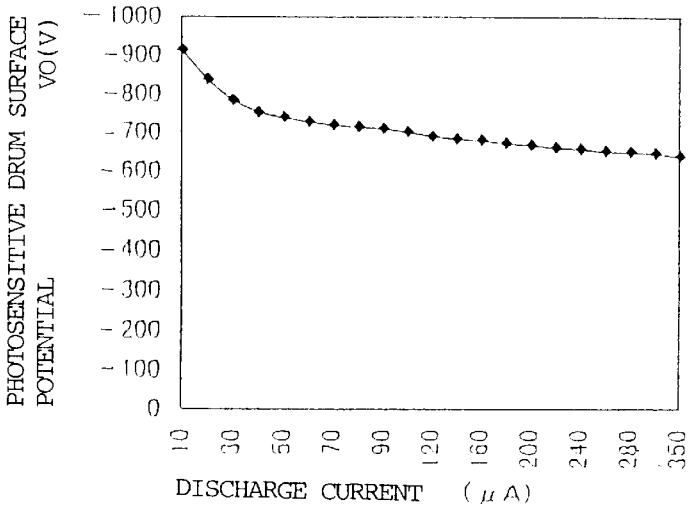
FIG. 5 is a graph showing measured values of the surface potential of the photosensitive drum with respect to the discharge current of a Scorotron charger.

FIG. 5 shows a result of measurement of the discharge current of the Scorotron charger 81 necessary for changing the surface potential of the photosensitive drum 20, once charged by the Corotron charger to −1200 V, up to −700 V. In this case, the grid voltage is set to −700 V.

As seen in FIG. 5, in the case of Scorotron charger 81, the surface potential of the photosensitive drum 20 can be varied to −700 V by the discharge current of about +70 μA. It is also found that the surface potential may be stably maintained at approximately −700 V even if the discharge current is varied to about +300 μA. In this embodiment, the discharge current of the Scorotron charger 81 is set to +150 μA.

It is generally known that the ozone concentration created by the positive polarity discharge is about ten times smaller than that created by the negative polarity discharge. Therefore, the ozone concentration is sufficiently low in the case that the discharge current of the Scorotron charger 81 is 150 μA.

As described above, in this embodiment, not only the discharge current of the Corotron charger 80 performing the negative polarity discharge, but also the discharge current of the Scorotron charger 81 performing the positive polarity discharge is reduced to be about 150 μA. Hence, the ozone concentration may be remarkably reduced.

Figure 6:
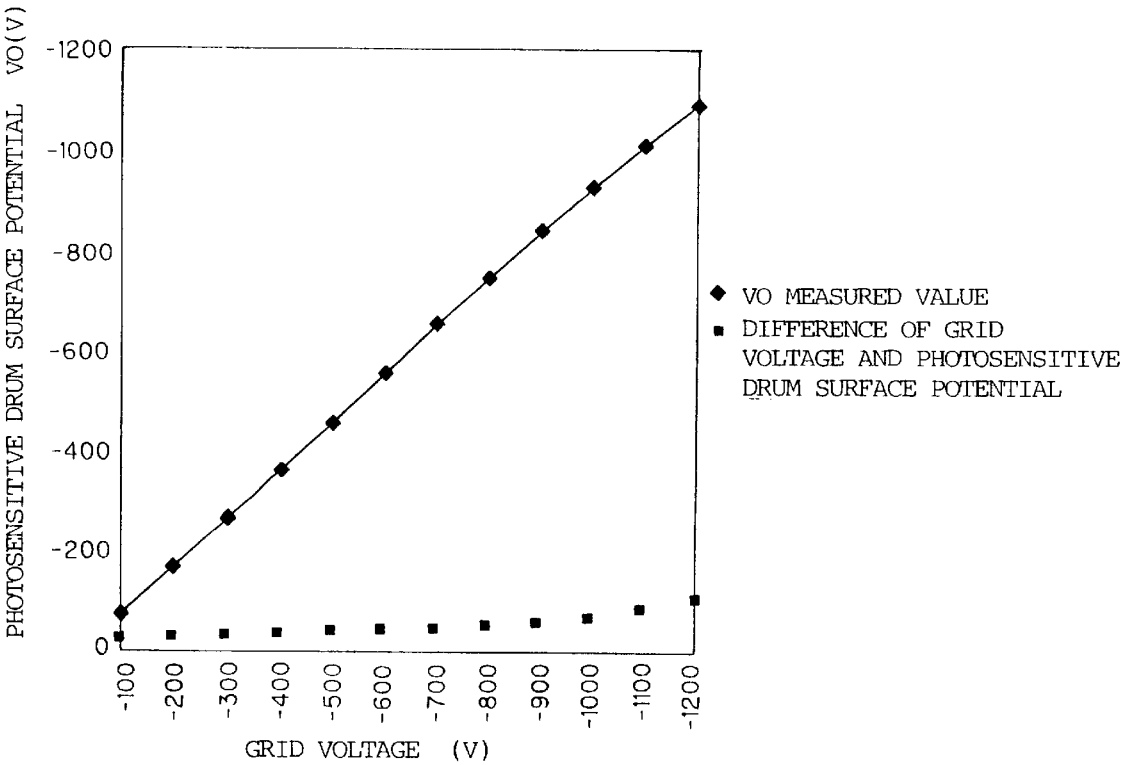
FIG. 6 is a graph showing the relation between measured values of surface potentials of the photosensitive drum and differences of the grid voltage and the surface potentials, with respect to the grid voltage of the Scorotron charger.

As shown in FIG. 6, the difference between the grid voltage of the Scorotron charger 81 and the surface voltage of the photosensitive drum 20 is quite small, and this proves that the apparatus of this embodiment configured as described above has excellent grid control ability.

According to this embodiment, the ozone production can be suppressed and the photosensitive drum can be stably charged.

Figure 7:
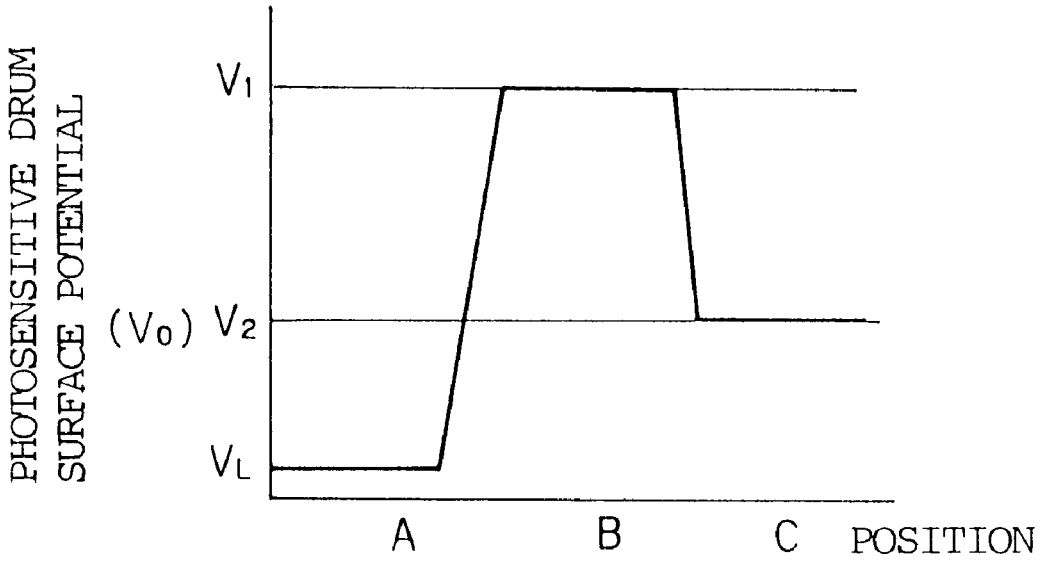
FIG. 7 is a graph showing the variation of the surface potential of the photosensitive drum with respect to certain positions thereof.

Next, the charged voltage range of the photosensitive drum 20 by the Corotron charger 80 will be studied. FIG. 7 shows the surface potential of the photosensitive drum 20. The position A is a position before the charging by the Corotron charger 80, the position B is a position after the charging by the Corotron charger 80, and the position C is a position after the charging by the Scorotron charger 81.

In this embodiment, as seen in FIG. 7, the surface potential of the photosensitive drum 20 is first charged to the negative high voltage V1, and then the positive polarity discharge is performed to regulate the surface voltage to a desired negative voltage V2.

However, it is generally known that organic photosensitive unit causes surface dielectric breakdown and produces spots on the surface if the surface potential is excessively high. Even if the surface potential is not high enough to cause the dielectric breakdown, a phenomenon called "dark attenuation" may possibly take place. The "dark attenuation" is a phenomenon that the surface potential of the photosensitive drum is lowered by the resistance of the photosensitive drum itself even if the exposure is not performed.

Therefore, in order to obtain stable image by the configuration of this embodiment, it is necessary to avoid the dielectric breakdown due to the charging by the Corotron charger 80. In addition, it is preferred that the potential set by the Scorotron charger 81 does not result dark attenuation.

In this view, assuming that the absolute value of the surface potential after the charging by the Scorotron charger 81 is V2 and the absolute value of the surface potential after the charging by the Corotron charger 80 is V1, it is possible to avoid dielectric breakdown by setting V1to satisfy:

$V1 < 3.0$ kV.

In addition, by setting V2 to satisfy:

$V2 < 1.5$ kV, the dark attenuation after the completion of the charging can be avoided. In this embodiment, the condition:

$V2 \leqq V1 < 1.5$ kV, is set so that the charged potential by the Corotron charger 80 is also controlled to avoid the dark attenuation.

There is no limitation on the difference between the surface potential V1 after the charging by the Corotron charger 80 and the surface potential V2 after the charging by the Scorotron charger 81. However, the difference is needed to be at least 100 V in consideration of the irregularity of the charged state by the Corotron charger 80.

The setting of the surface potential V1 by the Corotron charger 80 after the charging is also important in view of setting the charging efficiency. As a result of experiments under various conditions, it is found that the charging efficiency of more than 10% can sufficiently suppress the ozone production. Therefore, it is necessary to set the surface potential value V1 in consideration of the configuration of the Corotron charger 80, the spacing between the discharge wire 80*a* and the photosensitive drum 20 so that the charging efficiency of more than 10% is achieved.

Next, the image forming operation of this embodiment will be described. In this embodiment, the effective developing bias voltage of the developing roller 56 is set approximately to −200 V. At the same time, since the electrostatic latent image voltage, which is a voltage of the electrostatic latent image formed on the photosensitive drum 20, is approximately −100, the developing bias voltage of the developing power supply E applied to the photosensitive drum 20 is set approximately to −300 V.

When the image forming process is started under the voltage setting condition described above, first the charge elimination lamp 41 clears the remaining charges on the photosensitive drum 20. Then the surface of the photosensitive drum 20 is charged approximately to −200 V by the negative polarity discharge by the Corotron charger 80, and then is uniformly charged approximately to −700 V by the positive polarity discharge of the Scorotron charger 81.

Figure 8:
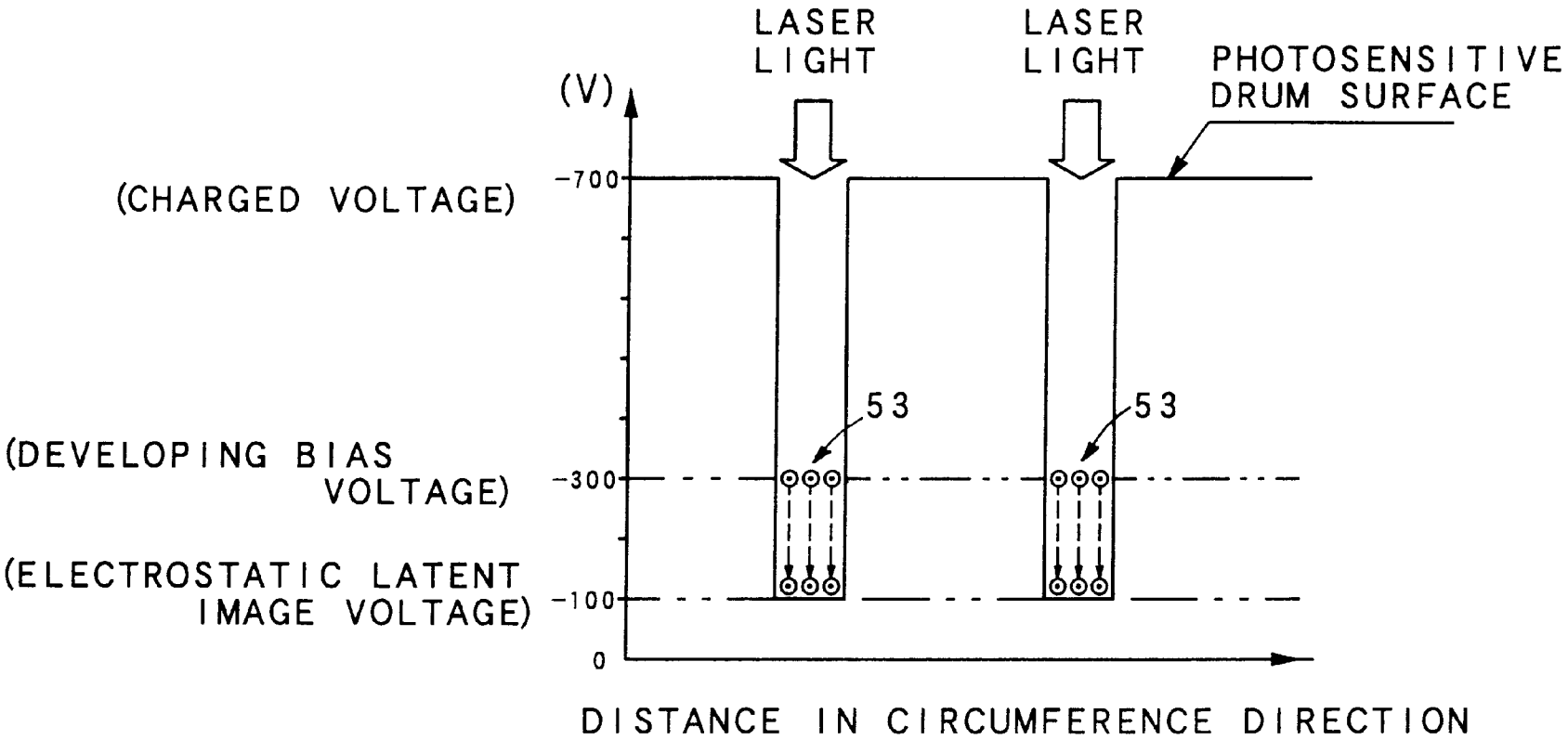
FIG. 8 is an explanatory view of potentials of portions in a developing process by the reversal developing method performed by the laser beam printer shown in FIG. 1.

Under this condition, the laser light L emitted by the laser generator 31 is primarily scanned by the polygon mirror 32 to pass through the lenses 33 and 34 and the reflective mirrors 35 and 36 to be irradiated on the photosensitive drum 20, and thereby the electrostatic latent image is formed on the photosensitive drum 20. At this time, the voltage of the surface portion of the photosensitive drum 20 corresponding to the electrostatic latent image is lowered approximately to −100 V by the irradiation of the laser light L, as shown in FIG. 8 for example. Under the condition that the voltage −300 V, for example, is applied as the developing bias voltage as shown in FIG. 8, the negative polarity toner 53 adheres on the surface of the developing roller 56 to form a layer of a given thickness. Therefore, the toner 53 is not attracted by the charged voltage (approximately −700 V) lower than that of the toner 53 itself, but is attracted by the charged voltage (approximately −100 V) higher than that of the toner 53, so that the toner 53 on the developing roller 56 adheres only to the electrostatic latent image formed on the photosensitive drum 20 to be developed. The toner image developed by the toner 53 is transferred to the paper P by the transfer roller 60, and then is fixed by the fixing unit 70 to be delivered to the paper output tray 77.

Figure 9:
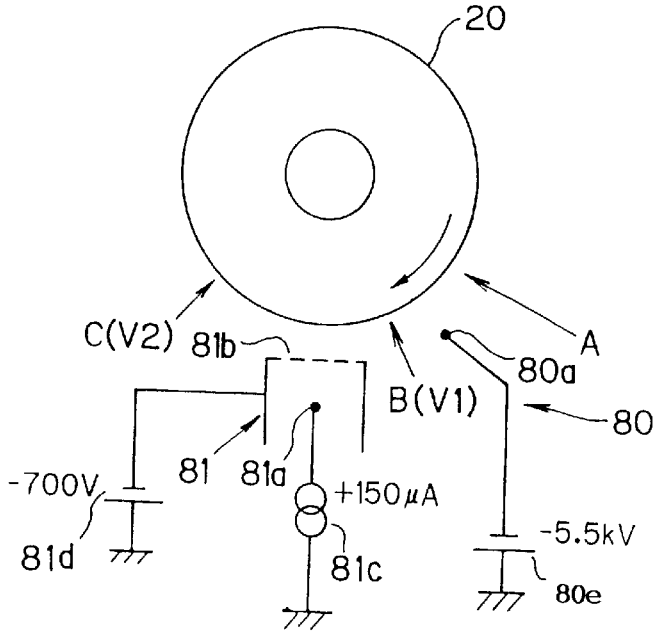
FIG. 9 is a schematic diagram showing an alternative configuration of a charging unit of the laser beam printer shown in FIG. 1.

Next, an alternative form of the charging unit will be described. FIG. 9 shows a configuration of an alternative charging unit, which can be used in this embodiment in place of the charging unit shown in FIG. 3. As seen in FIG. 9, the charging unit is configured such that the a constant current driving circuit 80*e* is provided in place of the power supply 80*b* shown in FIG. 3 and the constant current driving circuit 80*e* supplies a constant current, −20 μA in this example, to the discharge wire 80*a* of the Corotron charger 80. The reason for this configuration will be described below.

Figure 10:
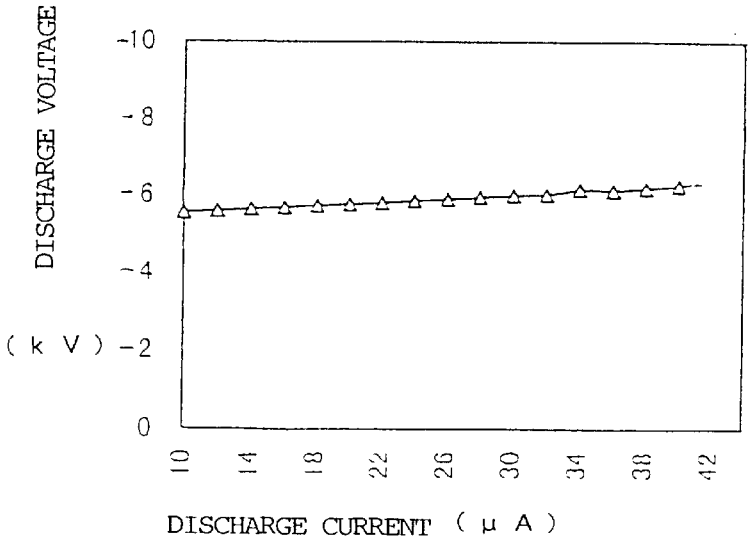
FIG. 10 is a graph showing the relation between the discharge current and the discharge voltage.

FIG. 10 shows the relationship between the discharge current of the Corotron charger 80 and the discharge voltage in this embodiment. As seen in FIG. 10, even when the discharge current is varied from 10 μA to 42 μA, the variation range of the discharge voltage is only about 400 V. Therefore, if the power supply voltage varies only some ten volts, the discharge current varies about 2 μA. If the discharge current varies about 2 μA, the surface potential of the photosensitive drum 20 varies about 250 V as seen in FIG. 4, and the stable charging becomes difficult. In addition, the variation of the discharge current leads to the variation of the charging efficiency, and this is disadvantageous for reducing ozone concentration.

To overcome this disadvantage, the charging unit shown in FIG. 9 is provided with the constant current driving circuit 80*e* which supplies a constant current to the discharge wire 80*a*. As a result, the discharge current can be readily maintained at a desired value, and the charging efficiency can be stably maintained at an appropriate value. Further, since the charging efficiency is stably maintained, the ozone concentration can be reduced and an excellent image forming apparatus in respect of environmental sanitation can be provided.

Next, a modification of the charging unit shown in FIG. 9 will be described. If the voltage application to the Corotron charger 80 is carried out by using the constant current driving circuit, the following problem may take place. If the laser beam printer of the above configuration is used for a long time, the thickness of the photosensitive layer of the photosensitive drum 20 is reduced due to the friction thereof, and the electrostatic capacity increases. Therefore, if the voltage is applied to the Corotron charger 80 by the constant current driving circuit, the surface potential of the photosensitive drum 20 may be lowered. In addition, if there is a pinhole on the photosensitive drum 20, the spark may happen. A large current may flow due to the spark, possibly causing a dielectric breakdown of the photosensitive drum 20.

Figure 11:
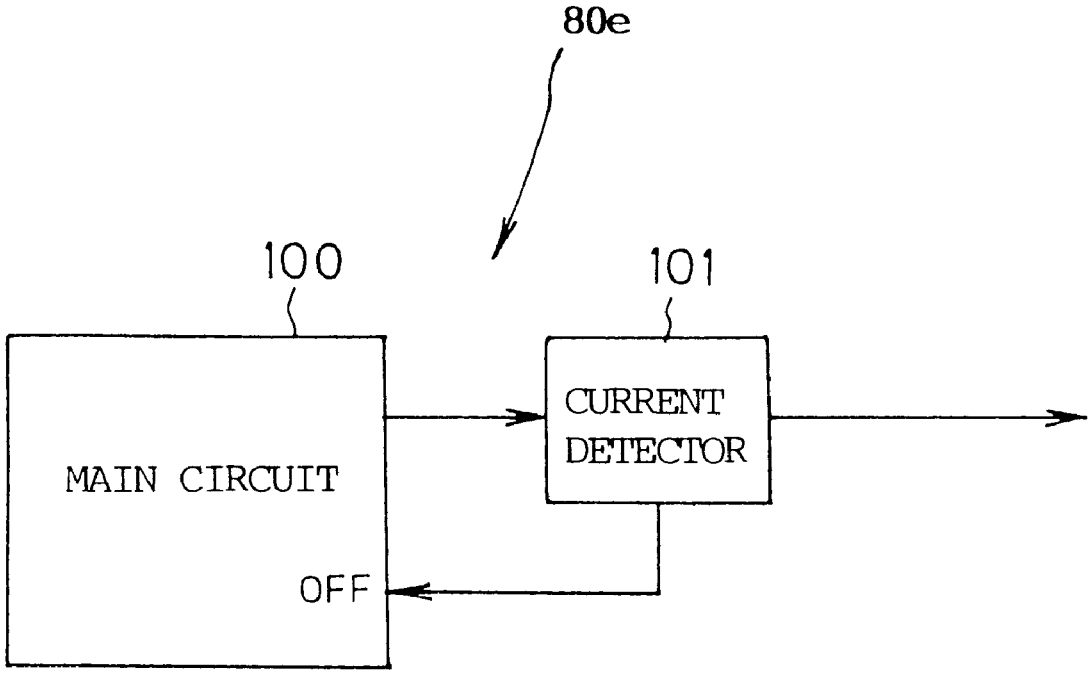
FIG. 11 is a block diagram showing a constant current driving circuit with current limiting function employed in a modification of the charging unit.

In this view, the charging unit shown in FIG. 9 may be modified such that the constant current driving circuit 80*e* has current limiting function. The constant current driving circuit 80*e* according to this modification may be configured as shown in FIG. 11, and includes a main circuit 100 and a current detector 101. If the current detector 101 detects an excessive current larger than a predetermined value, it supplies a break signal to the main circuit 100 to terminate the performance of the main circuit 100 of the constant current driving circuit 80*e*. The circuit 80*e* may be designed such that the current detector 101 outputs the break signal when it detects the current larger than −500 μA. With this modification, the dielectric breakdown of the photosensitive drum 20 may be avoided and the image may be stably obtained in a long time use of the laser beam printer.

In this modification, the performance of the main circuit 100 of the constant current driving circuit 80*e* is terminated when the current exceeds the predetermined limit. In addition to this, the apparatus may be configured to supply the break signal to the controller of the laser beam printer to represent an indication or a warning such as a serviceman call message on a display unit of the printer to notify the user of that situation.

As described above, according to the present invention, good image formation may be achieved with the reduced ozone concentration, even if the negative charging photosensitive unit and negative charging developer are used, thereby providing an image forming apparatus preferable in view of environmental sanitation. Additionally, by setting the spacing between the Corotron charger and the photosensitive drum in the appropriate range as discussed above, the damage on the photosensitive drum due to the streamer discharge may be avoided and reliable charging may be performed with appropriate applied voltage.

Further, if the stable discharge current is supplied to the Corotron charger by the constant current driving circuit 80*e* as shown in FIG. 9, the charging efficiency can be stably maintained at an appropriate value, thereby enabling further reduction of the ozone concentration.

Still further, if the constant current driving circuit is configured to have the current limiting function as shown in FIG. 11, the dielectric breakdown of the photosensitive drum may be avoided and the reliable image formation may be achieved for a long time.

The above described embodiment is directed to the case where the image forming apparatus of the present invention is applied to a laser beam printer. However, the application of this invention is not limited to this feature and is also applicable to a copy machine and the like. In the application to a copy machine, it is conceivable to perform, not the reversal development, but regular development with background exposure. However, by using the developer of positively charging property, the configuration of the above embodiment can be applied.

While the above mentioned embodiment is only directed to the monochrome image formation, the present invention is effectively applicable to the color image formation. While the developing roller 56 and the photosensitive drum 20 are designed to rotate in the same direction (in the opposite direction at the contact surface) in the above mentioned embodiment, they may be rotated in the opposite directions. The photosensitive unit in a form of belt-like shape, alternatively to the drum shape described above, may achieve the same effect. While above embodiment is directed to the laser beam printer, the present invention is applicable and can achieve the same effect if applied to any kind of image forming apparatus of electrophotography type, using toner, such as a copy machine, a facsimile and the like.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Applications Nos. 09-265853, 09-265854, 09-265855 and 09-265856, all filed on Sep. 30, 1997, including the specification, claims, drawings and summary is incorporated herein by reference in its entirety.

What is claimed is:

1. An image forming apparatus comprising:

a photosensitive unit having a surface of negatively charging property and moved in a predetermined direction;

a first charging device disposed opposite to said photosensitive unit with a first spacing therebetween and for charging the surface of said photosensitive unit to a first charged potential of negative polarity by a negative voltage;

a second charging device disposed opposite to said photosensitive unit with a second spacing therebetween at a position downstream of said first charging device in a movement direction of said photosensitive unit and for charging the surface of said photosensitive unit charged by said first charging device to a second charged potential of negative polarity by a positive voltage, the second charged potential having an absolute value smaller than an absolute value of the first charged potential;

an electrostatic latent image forming device for forming an electrostatic latent image on said photosensitive unit; and a developer carrying device for carrying and conveying developer and for developing the electrostatic latent image formed by said electrostatic latent image forming device by using the developer to form a visible image, wherein a charging efficiency of said first charging device is set to be larger than 10%.

2. An apparatus according to claim 1, wherein said first charging device comprises:

a first discharge wire disposed opposite to said photosensitive unit with the first spacing; and a first power supply for allowing the first discharge wire to produce a negative voltage, said first charging device charging the surface of said photosensitive unit to the first charged potential with the charging efficiency larger than 10%, and said second charging device comprising:

a second discharge wire disposed opposite to said photosensitive unit with the second spacing;

a second power supply for allowing the second discharge wire to produce a positive voltage; and a control electrode disposed between the second discharge wire and the photosensitive unit and having a negative potential which absolute value is smaller than the absolute value of the first charged potential, said second charging device charging the surface of the photosensitive unit charged to the first charged potential by said first charging device to the second charged potential which is substantially equal to the potential of the control electrode.

3. An apparatus according to claim 1, wherein said first charging device comprises a Corotron charger and said second charging device comprises a Scorotron charger having a grid electrode.

4. An apparatus according to claim 1, wherein said first charged potential is smaller than a potential at which a dielectric breakdown of the photosensitive unit takes place and said second charged potential is smaller than a potential at which a dark attenuation of the photosensitive unit takes place.

5. An apparatus according to claim 1, wherein said developer comprises non-magnetic one-component toner of negatively charging property, said developer carrying device making a contact with the photosensitive unit to form a nip portion between the developer carrying device and the photosensitive unit and developing the electrostatic latent image at the nip portion.

6. An apparatus according to claim 1, wherein said first charging device comprises a constant current driving circuit.

7. An apparatus according to claim 1, wherein said first charging device comprises:

a first discharge wire disposed opposite to said photosensitive unit with the first spacing; and a constant current driving circuit for supplying a constant current to the first discharge wire to allow the first discharge wire to produce a negative voltage, said first charging device charging the surface of said photosensitive unit to the first charged potential with the charging efficiency larger than 10%, and said second charging device comprising:

a second discharge wire disposed opposite to said photosensitive unit with the second spacing;

a power supply for allowing the second discharge wire to produce a positive voltage; and a control electrode disposed between the second discharge wire and the photosensitive unit and having a negative potential which absolute value is smaller than the absolute value of the first charged potential, said second charging device charging the surface of the photosensitive unit charged to the first charged potential by said first charging device to the second charged potential which is substantially equal to the potential of the control electrode.

8. An apparatus according to claim 7, wherein said first charging device comprises a Corotron charger and said second charging device comprises a Scorotron charger having a grid electrode, said constant current driving circuit controlling the current supplied to the discharge wire of the Scorotron charger to be constant.

9. An apparatus according to claim 7, wherein said first charged potential is smaller than a potential at which a dielectric breakdown of the photosensitive unit takes place and said second charged potential is smaller than a potential at which a dark attenuation of the photosensitive unit takes place.

10. An apparatus according to claim 7, wherein said developer comprises non-magnetic one-component toner of negatively charging property, said developer carrying device making a contact with the photosensitive unit to form a nip portion between the developer carrying device and the photosensitive unit and developing the electrostatic latent image at the nip portion.

11. An apparatus according to claim 1, wherein said first charging device comprises a constant current driving circuit having current limiting function.

12. An apparatus according to claim 1, wherein said first charging device comprises:

a first discharge wire disposed opposite to said photosensitive unit with the first spacing; and a constant current driving circuit having current limiting function for supplying a voltage to the first discharge wire to allow the first discharge wire to produce a negative voltage, said first charging device charging the surface of said photosensitive unit to the first charged potential with the charging efficiency larger than 10%, and said second charging device comprising:

a second discharge wire disposed opposite to said photosensitive unit with the second spacing;

a power supply for applying a positive voltage to the second discharge wire; and a control electrode disposed between the second discharge wire and the photosensitive unit and having a negative potential which absolute value is smaller than the absolute value of the first charged potential, said second charging device charging the surface of the photosensitive unit charged to the first charged potential by said first charging device to the second charged potential which is substantially equal to the potential of the control electrode.

13. An apparatus according to claim 12, wherein said first charging device comprises a Corotron charger and said second charging device comprises a Scorotron charger having a grid electrode, said constant current driving circuit controlling the voltage applied to the discharge wire of the Scorotron charger to be constant and controls the current supplied to the discharge wire not to exceed a predetermined value.

14. An apparatus according to claim 12, wherein said first charged potential is smaller than a potential at which a dielectric breakdown of the photosensitive unit takes place and said second charged potential is smaller than a potential at which a dark attenuation of the photosensitive unit takes place.

15. An apparatus according to claim 12, wherein said developer comprises non-magnetic one-component toner of negatively charging property, said developer carrying device making a contact with the photosensitive unit to form a nip portion between the developer carrying device and the photosensitive unit and developing the electrostatic latent image at the nip portion.

16. An apparatus according to claim 1, wherein a spacing between said first charging device and the photosensitive unit is larger than 1 mm and smaller than 30 mm.

17. An apparatus according to claim 1, wherein said first charging device comprises:

a first discharge wire disposed opposite to said photosensitive unit with a spacing larger than 1 mm and smaller than 30 mm; and a first power supply for allowing the first discharge wire to produce a negative voltage, said first charging device charging the surface of said photosensitive unit to the first charged potential with the charging efficiency larger than 10%, and said second charging device comprising:

a second discharge wire disposed opposite to said photosensitive unit with the second spacing;

a second power supply for allowing the second discharge wire to produce a positive voltage; and a control electrode disposed between the second discharge wire and the photosensitive unit and having a negative potential which absolute value is smaller than the absolute value of the first charged potential, said second charging device charging the surface of the photosensitive unit charged to the first charged potential by said first charging device to the second charged potential which is substantially equal to the potential of the control electrode.

18. An apparatus according to claim 17, wherein a spacing between the first charging device and the control electrode is larger than 1 mm and smaller than 30 mm.

19. An apparatus according to claim 17, wherein said first charging device comprises a Corotron charger and said second charging device comprises a Scorotron charger having a grid electrode.

20. An apparatus according to claim 17, wherein said developer comprises non-magnetic one-component toner of negatively charging property, said developer carrying device making a contact with the photosensitive unit to form a nip portion between the developer carrying device and the photosensitive unit and developing the electrostatic latent image at the nip portion.

* * * * *